United States Patent [19]

Vogt

[11] Patent Number: 4,457,215

[45] Date of Patent: Jul. 3, 1984

[54] DUCT AIR COVER

[76] Inventor: Edward H. Vogt, 118 E. 46th St., Tacoma, Wash. 98404

[21] Appl. No.: 384,435

[22] Filed: Jun. 2, 1982

Related U.S. Application Data

[63] Continuation of Ser. No. 129,999, Mar. 18, 1980, abandoned.

[51] Int. Cl.[3] ..... F24F 13/10

[52] U.S. Cl. ..... 98/103; 98/119

[58] Field of Search ..... 98/102, 103, 107, 106, 98/108, 116, 119

[56] References Cited

U.S. PATENT DOCUMENTS

| | | | |
|---|---|---|---|
| 1,309,430 | 7/1919 | Woodall | 98/101 |
| 1,709,650 | 4/1929 | Allen | 98/103 |
| 2,074,024 | 3/1937 | Phail | 98/119 |
| 2,631,519 | 3/1953 | Sprouse et al. | 98/116 |
| 3,143,953 | 8/1964 | Bristol | 98/116 |
| 3,926,102 | 12/1975 | Delepeleire | 98/102 |
| 4,108,238 | 8/1978 | Vary et al. | 98/116 |

*Primary Examiner*—Albert J. Makay
*Assistant Examiner*—Harold Joyce
*Attorney, Agent, or Firm*—Kenneth S. Kessler

[57] ABSTRACT

A duct air cover is disclosed which allows for the easy escape of air when it is being forced under pressure but cuts off drafts of air not under pressure. Two lightweight air deflector flaps are hinged at opposing sides of an air duct. When temperature controlled air is forced through the duct in question, the lightweight flaps are easily lifted from the register by the air pressure itself thereby allowing for the flow of temperature controlled air. However, when the air is no longer forced, the flaps return to a closed position thus preventing cold drafts of air from flowing out through the ducts.

3 Claims, 3 Drawing Figures

DUCT AIR COVER

This is a continuation, of application Ser. No. 129,999, filed Mar. 18, 1980 now abandoned.

BACKGROUND OF THE INVENTION

In most commercial and residential buildings air ducts pass either outside the building or in non-insulated areas of the building. Thus, the ducts present a problem of allowing drafts to pass from the ducts when air is not being passed from the ducts.

A number of U.S. patents have addressed this problem.

In U.S. Pat. No. 1,309,430 by W. J. Woodall a deflector plate is hinged to direct air flow. However, the deflector requires manual positioning and does not cut off potential cold drafts.

Similarly, in U.S. Pat. No. 2,284,912 by J. E. Maynard, et al, a damper is disclosed. As in other patents, however, the position of the damper is set and changed manually.

The advantage of the disclosed device lies in its ability to react without manual direction. Thus, forced air opens the duct air flaps which close due to their own weight when the forced air ceases.

SUMMARY OF THE INVENTION

A duct air cover is designed to include two air deflector flaps which are pivotally connected to a frame. The frame is capable of being secured to a conventional register.

The air deflectors are sufficiently light to allow forced air to pivot them into an open position. However, when the forced air ceases, the flaps pivot shut due to their own weight. When shut, the two air deflector flaps completely cover the duct and prevent the escape of any cold air drafts.

DETAILED DESCRIPTION OF THE DRAWINGS

Figure 1:
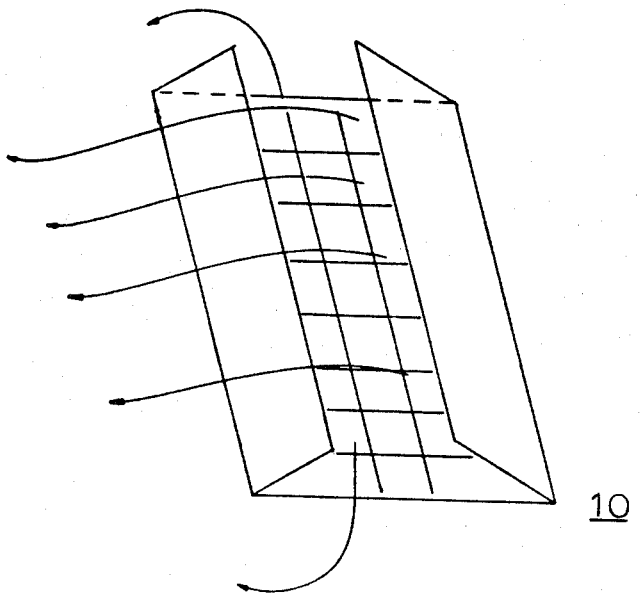
FIG. 1 is a perspective view of the duct air deflector with temperature controlled air being forced into a room.

A perspective view of the duct air deflector 10 is illustrated in FIG. 1. The duct air deflector 10 is capable of being used in conjunction with a standard air register 12 in controlling the flow of forced air and likewise cutting off unwanted drafts. In most residential and commercial buildings temperature controlled air flows through conventional ducts. A register acts as the interface between the duct 12 and the subject room.

Figure 2:
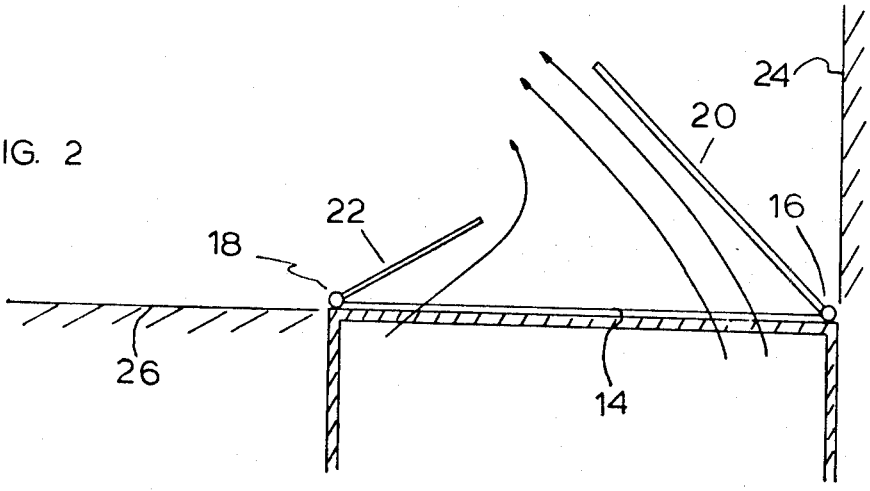
FIG. 2 is a side view of the duct air deflector in the open position with temperature controlled air being forced into a room.

In FIG. 2 a side view of the duct air deflector 10 is depicted showing the duct air deflector 10 in the open position. The frame 11 of the duct air deflector is capable of easy attachment to a conventional register face plate 14. Attached to the frame 11 are hinges 16 and 18. Hinges 16 and 18 in the preferred embodiment are designed to be near friction free.

Attached to the hinges 16 and 18 are air deflector flaps 20 and 22. As set forth in the preferred embodiment, air deflector flap 20 is longer than air deflector flap 22.

Air deflector flap 20 is closest to the adjoining wall 24 to the register. Thus, air is deflected towards the inner volume of the room and does not direct itself directly towards the ceiling as would be experienced when heated air is directly forced from an air register.

Air deflector flap 22 is shorter than air deflector flap 20. The air deflector flap 22 forces air towards the air deflector flap 20. Thus, when cool air is being forced out the register in the summer the air cannot escape along the floor 26.

The air deflector flaps 20 and 22 may be made of a number of lightweight materials including but not limited to heat resistant plastic.

In the preferred embodiment the air deflector flaps 20 and 22 are impervious to the flow of air but could be made of material that allows for a small percentage of air to pass through the flaps 20 and 22.

Also, in the preferred embodiment the hinges 16 and 18 are designed to reach and hold their position at a given angle. Thus, hinge 16 holds air deflector flap 20 at a 45° angle and hinge 18 holds air deflector flap 22 at a 30° angle.

Figure 3:
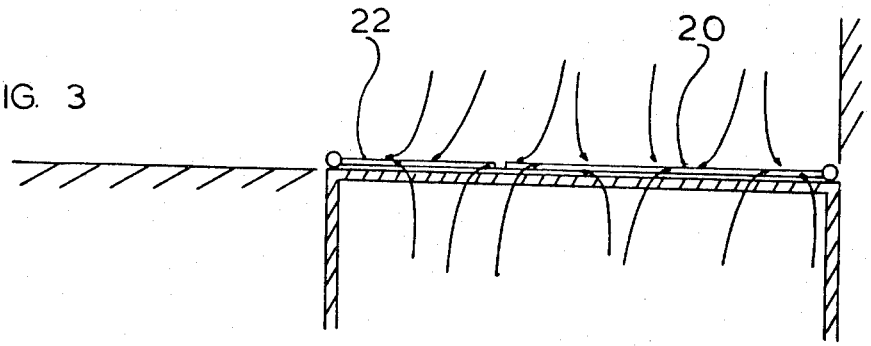
FIG. 3 is a side view of the duct air deflector with the two air deflector flaps in the closed position thus preventing drafts from escaping from the duct.

FIG. 3 illustrates the placement of the air deflector flaps 20 and 22 when the temperature controlled air is no longer being forced through the ducts 12. When air is no longer being forced through the ducts, the air pressure keeping the air deflector flaps 20 and 22 in the open position is no longer present. Thus, the weight of the air deflector flaps 20 and 22 in and of themselves cause their own closing.

When the air duct flaps 20 and 22 rest against the frame 11, as illustrated in FIG. 3, the air deflector flaps 20 and 22 prevent drafts to flow through the ducts 12 and enter the room in question. Since ducts typically run under homes and are subject to the elements, the closure can represent a considerable savings by shutting of cold air drafts.

The air deflector flaps 20 and 22 and the hinges 16 and 18 are constructed to preclude the necessity of any manual moving of parts. Thus, the prevention is caused automatically and the owner need not remember to either open or close the air deflector flaps 20 and 22.

The disclosed device may also be adapted to use on a wall. In this position, the hinge 16 that controls the lower air deflector flap 20 is biased towards the wall 24. Thus, after the forced air is discontinued, the hinge 16 with its bias towards the wall 24 causes the air deflector flap 20 to the wall 22.

The duct air deflector 10 is also effective when only one air deflector flap is used. In this configuration, the air deflector flap works under the same principal as when two flaps are deployed: the flap opening when air is being forced from the duct; and collapsing to cover the register when forced air is discontinued.

Although a particular preferred embodiment of the invention has been disclosed above for illustrative purposes, it is to be understood that variations or modifications thereof which lie within the scope of the appended claims are contemplated.

I claim:

1. An air duct air-deflector assembly, comprising:

a frame capable of being secured to an air register;

a first air deflector flap;

first hinge means connecting said first air deflector flap to one side of said frame such that said first air deflector flap is movable in a counterclockwise direction relative to said frame from its closed position to its open position under the influence of air issuing from said register, wherein said open position of said first air deflector flap is defined by means of an included angle defined between said first air deflector flap and said frame having a maximum value of approximately 30°;

a second air deflector flap;

second hinge means connecting said second air deflector flap to the opposite side of said frame such that said second air deflector flap is movable in a clockwise direction relative to said frame from its closed position to its open position under the influence of air issuing from said register, wherein said open position of said second air deflector flap is defined by means of an included angle defined between said first air deflector flap and said frame having a maximum value of approximately 45°; and said second air deflector flap has a surface area of approximately two times the surface area of said first air deflector flap, whereby when said first and second air deflector flaps move to their respective open positions, air issuing from said register and engaging said first air deflector flap will be directed toward said second air deflector flap, and substantially all of the air issuing from said register and said assembly will be directed outwardly from said assembly, and between the nonhinged ends of said first and second air deflector flaps, at an angle inclined with respect to said frame.

2. The air-deflector assembly of claim 1, wherein:

said first and second air deflector flaps are fabricated of lightweight material of sufficient mass so as to permit said flaps to close under the influence of gravity when the flow of air issuing from said register is terminated.

3. The air-deflector assembly of claim 1, wherein:

said first and second air deflector flaps completely cover said register when said flaps are disposed in their closed positions.

* * * * *